United States Patent [19]

Brinkerhoff

[11] 4,224,798

[45] Sep. 30, 1980

[54] SPLIT CYCLE ENGINE AND METHOD

[76] Inventor: VerDon C. Brinkerhoff, 917 Park Row, Salt Lake City, Utah 84105

[21] Appl. No.: 54,751

[22] Filed: Jul. 5, 1979

Related U.S. Application Data

[63] Continuation-in-part of Ser. No. 904,562, May 10, 1978, abandoned.

[51] Int. Cl.[3] ..... F01K 3/00

[52] U.S. Cl. ..... 60/652; 60/659; 417/228

[58] Field of Search ..... 60/659, 508, 407, 512, 60/652, DIG. 5; 62/401; 417/228, 243

[56] References Cited

U.S. PATENT DOCUMENTS

| | | | |
|---|---|---|---|
| 1,681,280 | 8/1928 | Bruckner | 417/228 |
| 2,108,785 | 2/1938 | Aikman | 417/228 |
| 3,677,008 | 7/1972 | Koutz | 60/407 |
| 4,100,745 | 7/1978 | Gyarmathy | 60/652 |

*Primary Examiner*—S. Clement Swisher

*Attorney, Agent, or Firm*—J. Winslow Young; H. Ross Workman; Rick D. Nydegger

[57] ABSTRACT

A split cycle engine apparatus and method, the apparatus including a combustion engine, a novel compressor apparatus driven by the combustion engine, a closed-cycle refrigeration system in cooperation with the compressor apparatus, and a pneumatic motor driven by compressed air from the compressor apparatus. Refrigerant in the compressor absorbs thermal energy from compressed air and assists in compressing the air. High pressure air from the compressor is stored in a storage tank and may be used to drive the pneumatic motor or other auxiliary equipment in addition to providing high pressure combustion air for the internal combustion engine.

14 Claims, 1 Drawing Figure

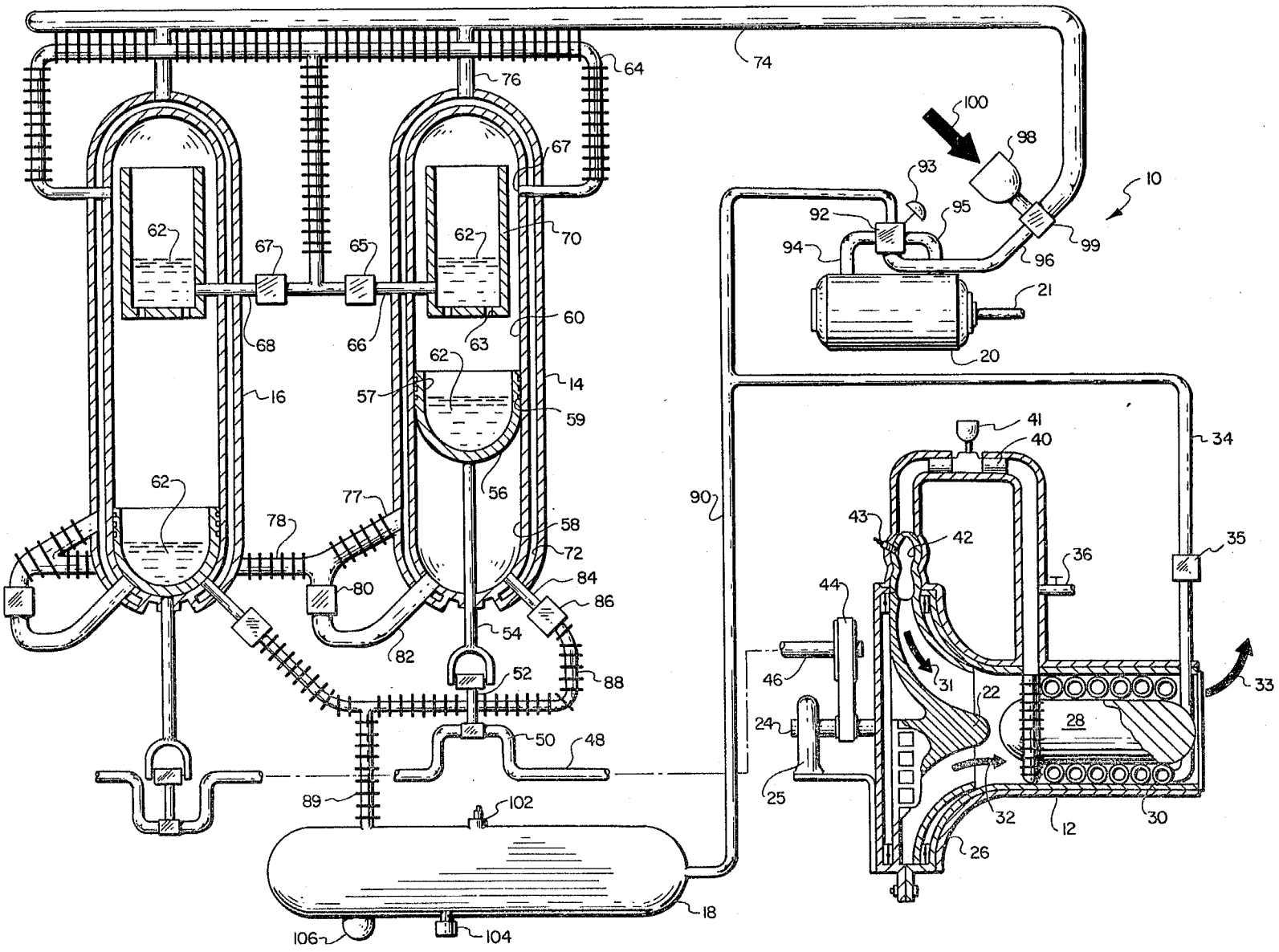
10
12
14
16
18
20
21
22
24
25
26
28
30
31
32
33
34
35
36
40
41
42
43
44
46
48
50
52
54
56
57
58
59
60
62
63
64
65
66
67
68
70
72
74
76
77
78
80
82
84
86
88
89
90
92
93
94
95
96
98
99
100
102
104
106

SPLIT CYCLE ENGINE AND METHOD

RELATED APPLICATIONS

This application is a continuation-in-part application of my copending application Ser. No. 904,562 filed May 10, 1978 for SPLIT CYCLE ENGINE now abandoned.

BACKGROUND

1. Field of the Invention

This invention relates to air standard engines and, more particularly, to an air standard engine apparatus and method, wherein pressurized air to drive an expansion engine is compressed generally isothermally within a refrigerant-cooled compressor/heat exchanger and the resulting high pressure air is stored at ambient temperature to be utilized in the expansion engine to produce mechanical energy after which the air is recycled to the compressor.

2. The Prior Art

Historically, the utilization of chemical energy stored within fossil fuels such as gasoline, diesel fuel, or the like, is accomplished by converting the chemical energy to thermal energy either in an internal or an external combustion engine with the engine converting the thermal energy to mechanical energy in a rotating shaft. The mechanical energy is then utilized directly through the use of transmissions, generators, pulleys, and the like. Therefore, the amount of mechanical energy produced for a particular function is controlled by the amount of thermal energy and, therefore, the amount of fuel consumed in the internal or external combustion engine, accounting for losses and inefficiencies. Accordingly, each engine is designed with a view toward the maximum power output requirements for that particular engine application even though the average work load may be substantially smaller. As a result, the engine is usually over-designed for the particular work requirements with a corresponding waste in fuel consumption during the extended periods of lower power requirements. In recognition of this problem, various energy storage devices have been proposed and include, for example, high-speed flywheels, batteries, air storage tanks, and the like. While air storage tanks present certain advantages, particularly since the storage medium (air) is plentiful, relatively safe, and the capital expenditure for air storage systems is relatively low, the disadvantages are in the various heat losses, particularly the heat of compression, that are incurred. The heat losses represent a lowering of the overall efficiency of the system and, where the heat is retained, an additional work load for the compressor to compress a given volume of air to a given pressure.

In view of the foregoing, it would be an advancement in the art to provide an air standard engine whereby air is compressed and held in a storage reservoir for subsequent expansion and recovery of energy therefrom through an expansion engine, the compression of the air being accomplished at a relatively low temperature by means of a refrigeration system removing thermal energy from the air. It would also be an advancement in the art to provide an air compressor apparatus wherein a refrigerant absorbs thermal energy from the air and at least a portion of that energy is used to increase pressure within the refrigerant to thereby assist in compressing the air. It would also be an advancement in the art to utilize a portion of the compressed air to recover heat from a combustion engine and use the heated air as the combustion air. Such an apparatus and method is disclosed and claimed herein.

BRIEF SUMMARY AND OBJECTS OF THE INVENTION

The present invention relates to a split cycle, air standard or pneumatic engine apparatus and method wherein pressurized air for driving the pneumatic engine is stored at high pressure and at ambient temperature for subsequent utilization in the pneumatic or expansion engine and also as a combustion air for a combustion engine. The pressurized air is produced in a refrigerant-assisted air compressor mechanically operated by the combustion engine. Thermal energy is absorbed from the compressed air by the refrigerant and the resulting pressure of the refrigerant is utilized to assist in compressing the air. Cooled exhaust air is recycled from the expansion engine and is utilized to cool the refrigerant thereby reducing the pressure of the refrigerant during the intake stroke of the compressor.

It is, therefore, a primary object of this invention to provide improvements in air standard engines.

Another object of this invention is to provide an improved method for converting thermal energy to mechanical energy.

Another object of this invention is to provide an improved air compressor apparatus wherein thermal energy developed during the compression cycle of the air is absorbed by a refrigerant, the thermal energy absorbed thereby increasing the pressure of the refrigerant to assist in compressing the air.

Another object of this invention is to provide an air compressor apparatus wherein a refrigerant-assisted air compressor is utilized to compress air with the pressure of the refrigerant being lowered by removing thermal energy therefrom with cool exhaust air recycled from the expansion engine.

These and other objects and features of the present invention will become more fully apparent from the following description and appended claims taken in conjunction with the accompanying drawing.

BRIEF DESCRIPTION OF THE DRAWING

The drawing is a schematic illustration of the apparatus of this invention with portions shown in cross section and also broken away to reveal internal construction for ease of presentation and understanding.

DETAILED DESCRIPTION OF THE PREFERRED EMBODIMENTS

The invention is best understood by reference to the drawing wherein like parts are designated with like numerals throughout.

General Discussion

A typical compressor is a reciprocating machine wherein air is compressed in a cylinder. The capacity of a compressor is measured in terms of standard cubic feet of gas and in industrial practice, a standard cubic foot is based on a temperature of 60° F. and an absolute pressure of 30 in. Hg. This corresponds to a molal volume of 378.7 cubic feet/lb mole. While standard compressors handle up to about 2,000 std. cubic feet/min., the capacity of a given machine depends on its volumetric efficiency (the ratio of the volume of gas delivered to the volume swept up by the piston) and which falls as the discharge pressure rises.

Importantly, the air is heated by the work of compression. Because of the heating, the gain in pressure in a single-stage compressor is limited, so that for high discharge pressures, multi-stage compressors are required. In small compressors handling very small amounts of gas, the rise in temperature of the gas on compression may be negligible. When there is no temperature change in the gas, the compression is said to be isothermal. More commonly, however, the gas is considerably hotter at the discharge than at the inlet. When there is no loss of heat to the surroundings, the compression is adiabatic. Accordingly, the power required to compress a gas depends on the inlet temperature, since a hot gas requires more work than a cold one, and on the mechanical efficiency, which is higher with heavy gasses than with light ones. The efficiency varies with the compression ratio, which is the ratio of the absolute discharge pressure to the absolute inlet pressure. In reciprocating compressors, the compression ratio is usually between about 2.5 and 6 in each stage while the adiabatic efficiency is a maximum of 80 to 85 percent at a compression ratio of about 4. In multi-stage compressors, the compression ratio should be the same in each stage, since the power drawn by each stage is the same. Between the stages of multi-stage compressors are intercoolers, which are air or water cooled heat exchangers to remove the heat of compression. Often an aftercooler or aftercondenser follows the last stage.

In summary, when a gas (air) is compressed, its volume is decreased and, therefore, work is done upon it. This work, in addition to the frictional losses of the compressor, must appear as heat. The mass of the compressed air is relatively small and, consequently, compressing the air results in an appreciable rise in temperature. For the most efficient operation of the compressor, this heat should be removed and the air discharged from the compressor as nearly as possible at the temperature at which it enters.

Referring now to the drawing, the split cycle engine apparatus of this invention is shown generally at 10 and includes a combustion engine 12, a first compressor 14, a second compressor 16, a storage tank 18, and an expansion engine 20. The combustion engine 12 is illustrated as a conventional turbine although it should be clearly understood that combustion engine 12 could include a conventional internal combustion (piston) engine, external combustion (steam) engine, or the like. However, for ease of illustration herein, reference will be made to combustion engine 12 being configurated as a conventional turbine.

Combustion engine 12 is a conventional turbine including a turbine rotor 22 rotatably mounted to a shaft 24 and housed in a turbine housing 26. An air heater 30 consisting of a coil of finned tube heat exchanger is wound around a cylindrical baffle 28 and receives pressurized air from inlet line 34. Combustion engine 12 is operated by using as combustion air, compressed air from line 34, controlled by a valve 35, and which passes through air heater 30 to thereafter be mixed with fuel from a fuel inlet 36. Supplemental combustion air is introduced through inlet 41 and controlled by check valve 40 to thereby provide sufficient oxygen for combustion. Additionally, the temperature of air introduced through air heater 30 is controlled by adjustment of its flow rate as set by valve 35 to preclude premature ignition of the fuel and air mixture. The fuel/air mixture is then directed to a combustion chamber 42 and ignited by an igniter apparatus 43. The hot combustion products (indicated schematically herein at 31) pass through a turbine rotor 22 turning the same as is conventional. The hot exhaust gasses, indicated schematically at 32, pass outwardly through the annular space around the baffle 28 and across air heater 30 heating the incoming air. The cooled exhaust is then exhausted to the atmosphere as cooled exhaust 33. A substantial portion of the thermal energy in hot combustion products 31 is therefore converted to mechanical energy turning shaft 34. Shaft 34 is mounted in pillow bearing 25 and is connected by belt 44 to shaft 46. Shaft 46 turns crankshaft 48. Crank 50 converts the rotary motion to a reciprocatory motion of a piston 56 in compressor 14.

Compressor 14 is configurated as a dual function compressor having a cylindrical vessel segregated by a piston 56 into an upper, refrigerant chamber 60 and a lower, compression chamber 58.

A piston rod 54 and a connecting rod 52 interconnect piston 56 to crank 50 so that rotation of crank 50 moves piston 56 in a reciprocatory manner in compression chamber 58 and refrigerant chamber 60. Piston 56 includes piston rings 59 and serves as a divider between the lower compression chamber 58 and the upper, refrigerant chamber 60. Piston 56 is configurated as a bowl-shaped piston having a piston refrigerant basin 57 formed therein to serve as a catchment basin for a body of refrigerant 62. Refrigerant 62 is in intimate thermal contact with the walls of piston 56 to thereby absorb thermal energy from air compressed within compression chamber 58. Thermal energy absorbed by refrigerant 62 volatilizes the same, increasing the pressure in refrigerant chamber 60 and producing a vapor which passes through a refrigerant outlet 67 into finned cooling coils 64. Finned cooling coils 64 are exposed to the ambient and are also in thermal contact with exhaust header 74. Condensed refrigerant is returned through check valve 65 into refrigerant reservoir 70 where it is discharged downwardly through pores 63 and again collects in piston refrigerant basin 57.

Air for compressor 14 is introduced through an inlet 76 into an intake plenum 72 formed as an annular chamber about the upper refrigerant chamber 60 and the lower compression chamber 58. The inlet air is then directed through a finned tube outlet 77, through a check valve 80, and inlet 82 into compression chamber 58. During its traversal of intake plenum 72, the inlet air is first cooled by contact with refrigerant chamber 60 and thereafter absorbs thermal energy from compressed air within compression chamber 58. The air then releases a portion of the absorbed thermal energy through finned outlet tube 77. Finned outlet tube 77 is also interconnected with an outlet header 78 interconnected with compressor 16 so that a multiple set of compressors, compressors 14 and 16, can be utilized.

Downward movement of piston 56 compresses air within compression chamber 58 forcing the same outwardly through outlet 84, check valve 86 into outlet conduit 88. Outlet conduit 88 includes a plurality of fins 89 thereon, the fins 89 serving to dissipate any residual thermal energy therein to the ambient. Thereafter, the compressed air is stored within storage tank 18 for subsequent utilization as will be set forth more fully hereinafter.

Compressed air storage tank 18 is illustrated schematically and is, therefore, shown as being relatively small. However, it is to be expressly understood that compressed air storage tank 18 is configurated as an energy storage reservoir and the capacity thereof will be dictated by the specific design of the overall system. As an energy storage system, compressed air storage tank 18 serves as a "battery" to provide for a simple self-starting of the system. Also, combustion engine 12 can be operated at maximum efficiency with the mechanical energy thus produced being efficiently stored as high pressure air in compressed air storage tank 18. Thus, momentary surges in shaft output demand on shaft 21 of expansion engine 20 are easily met by the reserve capacity of compressed air storage tank 18 without requiring a change in the operation of combustion engine 12. After the demand surge is over, the continued steady state operation of combustion engine 12 replenishes compressed air storage tank 18 so that a relatively small combustion engine 12 can be used to operate the overall system.

The compressed air in compressed air storage tank 18 is stored at ambient temperature as a result of being cooled by thermal contact with refrigerant 62, cold intake air in intake plenum 72, and finned outlet tube 88. The compressed air is directed by a high pressure conduit 90 to a valve 92 operated by a controller 93 and is directed to either forward conduit 94 or reverse conduit 95 into the expansion engine 20.

Expansion engine 20 is a conventional expansion engine and converts the pressure of high pressure air in conduit 90 to mechanical energy by rotation of shaft 21. Advantageously, expansion engine 20 can serve as either a prime mover or a braking mechanism, depending upon the direction the high pressure air from conduit 90 is introduced therein. For example, high pressure air directed through forward conduit 94 drives expansion engine 20 in a forward direction with the exhaust air passing through conduit 95 into exhaust conduit 96. The operator (not shown), through the use of controller 93, may change valve 92 so that the high pressure air from conduit 90 is directed through reverse conduit 95 driving expansion motor engine 20 in the reverse direction with the exhaust directed through conduit 94 into exhaust conduit 96. Accordingly, expansion engine 20 may be used for either a prime mover or a braking mechanism as set forth hereinbefore.

During periods when expansion engine 20 is inoperative or under low power conditions and compressors 14 and 16 are fully operational, additional or makeup air is supplemented to the system as intake air 100 through an intake 98 controlled by a check valve 99. The air, either as intake air 100 or exhaust air from exhaust outlet 96 is directed into exhaust plenum 74 which is in intimate thermal contact through finned tube 64. Advantageously, since the high pressure air in storage tank 18 is at ambient, expansion of the air through expansion engine 20 will result in a substantial cooling of the air. The cooling capability of the air in exhaust header 74 is then utilized for producing condensed refrigerant 62, as set forth hereinbefore.

Advantageously, the refrigerant heat transfer method of this invention provides for an approximately isothermal heat transfer of the heat of compression, thereby significantly reducing the work of compression in compressors 14 and 16. Additionally, the heat input to the refrigerant 62 causes a corresponding increase in pressure of the refrigerant with the positive force therein assisting the downward compression stroke of piston 56. Also, the cooled incoming air through exhaust header 74 causes a decrease in the refrigerant pressure and therefore a reduced pressure in refrigerant chamber 60 with a corresponding reduction in the forces exerted on piston 56 during the intake stroke or upward movement of piston 56.

Compressed air storage tank 18 includes a valve 102 which may be configurated either as a safety valve or an injection valve for initially charging air pressure within compressed air storage tank 18. Additionally, a conventional coupling 104 may be included for the purpose of coupling various pneumatic tools or devices to compressed air storage tank 18. A conventional liquid trap 106 may be included for the purpose of collecting and subsequent removal of condensed refrigerant, water, and the like from compressed air storage tank 18.

Since the production of mechanical energy is split between a compression cycle consisting of combustion engine 12 operating compressors 14 and 16 and an expansion cycle consisting of expansion engine 20 operated by compressed air from compressed air storage tank 18, the overall apparatus of this invention is referred to as a split cycle engine. Importantly, the work required to produce compressed air for compressed air storage tank 18 is substantially reduced by the novel refrigerant coolant/compression assist technique herein.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A split cycle engine system comprising:

a combustion engine means;

an air compressor means for compressing air and driven by the combustion engine means;

a closed cycle, refrigerant cooling system means for cooling the air compressed by the compressor means; and a pneumatic motor means operable by the compressed air.

2. The split cycle engine system defined in claim 1 wherein the combustion engine means includes conduit means for directing compressed air supplied by the air compressor means to the combustion engine means for use as combustion air.

3. The split cycle engine system defined in claim 2 wherein the combustion engine means includes heat exchange means for heating the combustion air with exhaust gasses generated by the combustion engine means and at least a portion of the combustion air is supplied by the air compressor means.

4. The split cycle engine system defined in claim 1 wherein the air compressor means further comprises a compressed air storage tank.

5. The split cycle engine system defined in claim 1 wherein the closed cycle, refrigerant cooling system means comprises a body of refrigerant in the compressor means and heat exchange means for absorbing heat energy from the air and cooling means for removing heat energy from the refrigerant.

6. The split cycle engine system defined in claim 5 wherein the cooling means comprises a heat exchange means in thermal contact with exhaust air from the pneumatic motor means.

7. The split cycle engine system defined in claim 1 wherein the air compressor means comprises at least one cylinder and a piston in the cylinder, the piston segregating the cylinder into a refrigerant chamber and a compression chamber, the piston compressing air in the compression chamber by movement in one direction with a refrigerant gas in the refrigerant chamber absorbing heat of compression with the piston serving as a heat exchange surface for transferring heat energy from the compressed air into the refrigerant gas.

8. The split cycle engine system defined in claim 7 wherein the piston comprises a refrigerant basin adapted to accommodate a body of refrigerant.

9. The split cycle engine system defined in claim 1 wherein the air compressor means comprises a double wall cylinder having an inner wall and an outer wall with an annular space between the inner wall and the outer wall, the annular space serving as a heat exchange means for inlet air to the air compressor means.

10. A split cycle engine system comprising:

a combustion engine means;

an air compressor means for compressing air, the air compressor means being driven by the combustion engine means and including at least one vertical cylinder and a piston reciprocatingly operable in the cylinder, the piston segregating the cylinder into a lower, compression chamber and an upper refrigerant chamber, the refrigerant chamber containing a body of refrigerant, the refrigerant absorbing heat energy from air compressed in the compression chamber, the heat energy absorbed by the refrigerant increasing the pressure in the refrigerant chamber and thereby assisting the combustion engine means in moving the piston downwardly to compress air in the compression chamber;

a cooling means external of cylinder for removing heat energy from the refrigerant; and a pneumatic motor means operable by compressed air from the air compressor means.

11. The split cycle engine system defined in claim 10 wherein the piston comprises a refrigerant basin adapted to contain a body of refrigerant in heat exchange relationship with air compressed in the air compressor means.

12. The split cycle engine system defined in claim 10 wherein the air compressor means comprises a spaced, double wall cylinder with an air inlet plenum for inlet air to the air compressor means between the spaced, double walls, the air inlet plenum providing heat exchange between inlet air and the refrigerant chamber and the compression chamber.

13. The split cycle engine system defined in claim 10 wherein the air compressor means further comprises a compressed air storage tank.

14. A method for converting thermal energy into mechanical energy comprising:

generating mechanical energy in a combustion engine and producing a first mechanical energy;

operating an air compressor means with the first mechanical energy to compress air;

assisting the first mechanical energy in compressing the air by removing heat energy from the air with a refrigerant, the refrigerant being volatilized by heat energy from the air and thereby increasing in pressure and assisting the first mechanical energy in compressing the air; and producing a second mechanical energy with a pneumatic motor means by directing the compressed air to the pneumatic motor means.

* * * * *